United States Patent [19]

Skolnik

[11] Patent Number: 5,046,875

[45] Date of Patent: Sep. 10, 1991

[54] IN SITU MOLDED PRODUCT SAMPLER WITH TILT-OFF CAP

[75] Inventor: Albert B. Skolnik, New York, N.Y.

[73] Assignee: Liz Claiborne, Inc., New York, N.Y.

[21] Appl. No.: 515,723

[22] Filed: Apr. 27, 1990

[51] Int. Cl.[5] ..... B65D 85/24

[52] U.S. Cl. ..... 401/49; 401/98; 401/132; 220/339; 215/253

[58] Field of Search ..... 401/29, 50, 130; 220/339, 337; 215/253, 235; 132/318, 320, 317

[56] References Cited

U.S. PATENT DOCUMENTS

| | | | |
|---|---|---|---|
| D. 94,875 | 3/1935 | Christy . | |
| D. 188,870 | 9/1960 | Middleton, Jr. et al. | D58/2 |
| D. 129,923 | 10/1941 | Kaltenbach . | |
| 1,626,927 | 5/1927 | Friedman . | |
| 1,894,727 | 1/1933 | Benner . | |
| 1,933,538 | 11/1933 | Brazelton | 132/1 |
| 2,042,584 | 6/1936 | Bustamante | 132/79 |
| 2,088,076 | 7/1937 | Winslow | 35/59 |
| 2,509,631 | 5/1950 | Dyer | 132/1 |
| 2,547,252 | 4/1951 | Bouchard et al. | 206/46 |
| 2,618,279 | 11/1952 | Reiffert | 401/98 |
| 3,028,002 | 4/1962 | Nicolle | 401/98 |
| 3,397,027 | 8/1968 | Harrison | 401/50 |
| 3,591,298 | 7/1971 | Green | 401/7 |
| 3,762,545 | 10/1973 | Warner et al. | 206/78 B |
| 4,471,874 | 9/1984 | Morane | 206/581 |
| 4,711,354 | 12/1987 | Bennett | 132/318 |
| 4,714,160 | 12/1987 | Bennett | 206/385 |
| 4,860,907 | 8/1989 | Sondal | 215/235 |

*Primary Examiner*—Richard J. Johnson

*Attorney, Agent, or Firm*—Kirschstein, Ottinger, Israel & Schiffmiller

[57] ABSTRACT

A product sampler includes a body partly filled with a moldable product sample, and a cap removably mounted on the body. The cap has an internal mold cavity filled with, and shaping, a portion of the product sample. This portion is exposed upon cap removal. During cap removal, the exposed sample portion is kept inviolate.

21 Claims, 2 Drawing Sheets

FIG. 1
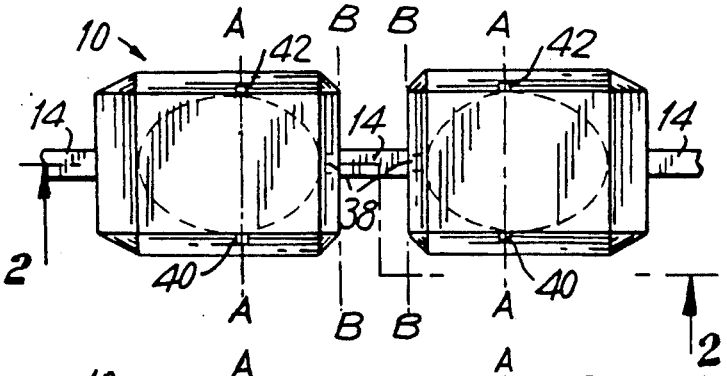
FIG. 2
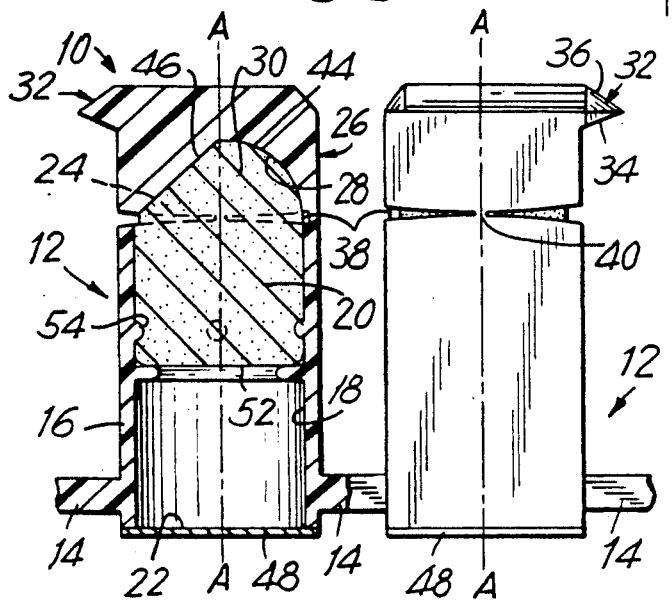
FIG. 3
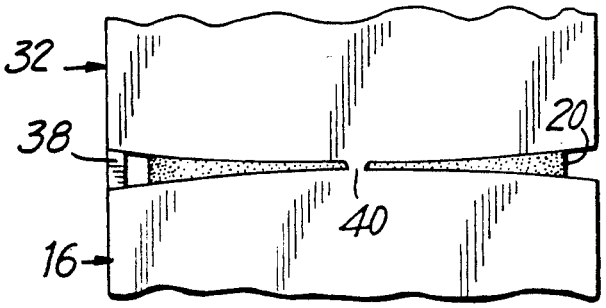
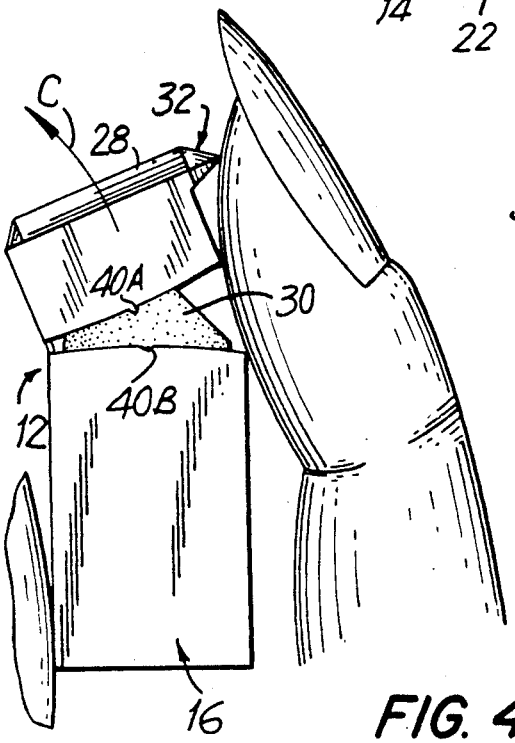
FIG. 4

FIG. 5
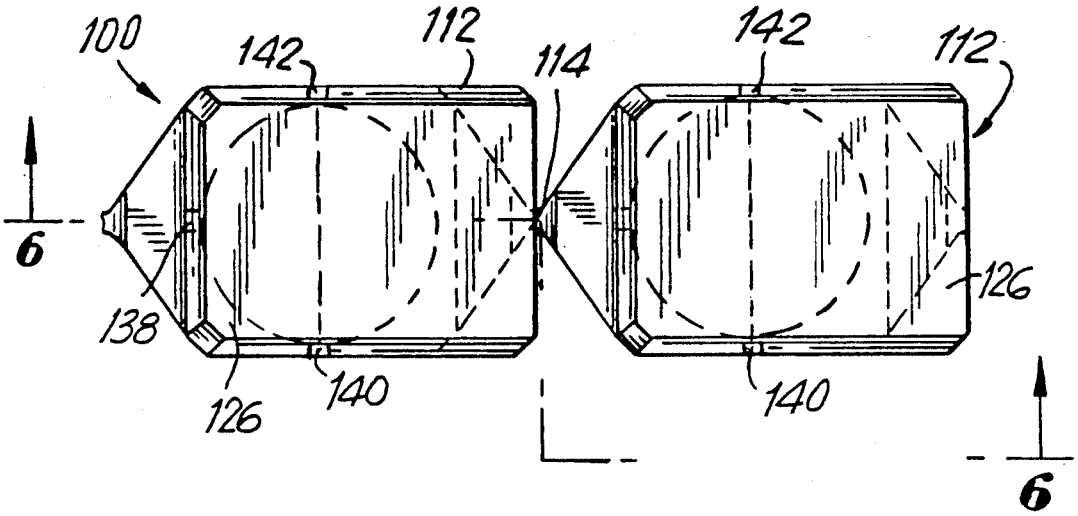
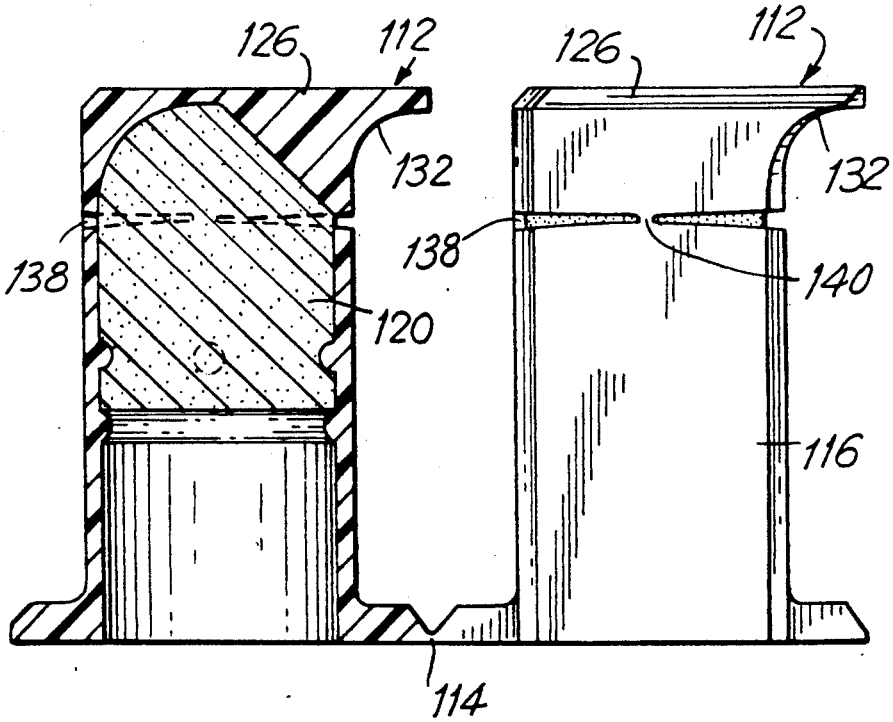
FIG. 6

IN SITU MOLDED PRODUCT SAMPLER WITH TILT-OFF CAP

BACKGROUND OF THE INVENTION

1. Field of the Invention

This invention generally relates to a product sampling arrangement with interconnected, miniature, disposable product samplers and, more particularly, to such samplers wherein lipsticks are molded in situ therein. Still more particularly, this invention relates to a method of making and a method of using the samplers.

2. Description of Related Art

Potential lipstick purchasers typically apply colored lipsticks to their lips or the backs of their hands prior to purchase for viewing the actual colors applied thereto. The colors displayed on the lipstick packages or presented by inspection of the lipstick itself may not be exactly duplicated after the lipsticks are actually applied to a person's lips or hands. Should one purchaser sample a lipstick intended for sale and then decide not to buy it, an unhygienic condition prevails for the next purchaser. Also, a retailer does not usually wish to sell a used product. Furthermore, purchasers have a right to obtain untampered, unopened products.

The art has proposed allowing purchasers to examine lipstick colors prior to purchase by providing miniature lipstick samplers which are used once and then discarded. For example, U.S. Pat. Nos. 1,626,927; 1,894,727; 2,042,584; 2,547,252; 4,471,874 and 4,714,160 are all illustrative of matchbook-style lipstick samplers, each including a plurality of rods, each having lipstick-coated ends for one-time application to one's lips. However, such lipstick-coated rods do not provide a sufficiently broad wiping area to spread the lipstick uniformly over the entire width and length of one's lips, at least not by a single stroke. Also, the lipstick-coated rods tend to smear on nearby surfaces of the matchbook dispensers, thereby making a mess.

Other lipstick samplers are disclose, for example, in U.S. Pat. Nos. 1,933,538; 3,591,298 and 4,711,354. The lipsticks in these samplers are protected by an overlying cover which may either be friction-fit or sonically welded to a lipstick holder. However, the friction-fit lipstick samplers have the drawback that they may tend to fall off, thereby leaving the lipstick unprotected. The sonically-welded lipstick samplers are removed by breaking the sonic welds, typically by twisting off the covers. However, experience has shown that such twisted-off covers mar the lipsticks during removal of the covers, again making a mess.

Still other lipstick samplers are disclosed in U.S. Pat. Nos. 2,088,076 and 2,509,631, as well as U.S. Des. Pat. Nos. D-94,875; D-129,923 and D-188,870. A lipstick display package wherein the colored lipstick is viewable through a transparent cover is disclosed in U.S. Pat. No. 3,762,545.

SUMMARY OF THE INVENTION

1. Objects of the Invention

It is an object of this invention to advance the state of the art of disposable product samplers, particularly cosmetic samplers such as lipsticks.

It is another object of this invention to enable a purchaser to sample a product without subjecting other purchasers to unsanitary conditions.

Another object of this invention is to enable a purchaser to reliably test a product in actual use.

Still another object of this invention is to mold a product sample in situ within the sampler.

Yet another object of this invention is to affirmatively attach a protective cap on a holder for the product sample.

A further object of this invention is to effectively remove the protective cap while resisting marring of the product sample during such removal.

Another object of this invention is to tilt the protective cap off the holder.

Yet a further object of this invention is to provide an inexpensive, disposable cosmetic sampler which is intended to be used once and then discarded.

Still another object of this invention is to frangibly interconnect a plurality of such product samplers in a packaging arrangement.

An additional object of this invention is to provide a novel method of making and a novel method of using a product sampler.

2. Features of the Invention

In keeping with these objects, and others which will become apparent hereinafter, one feature of this invention resides, briefly stated, in a product sampler which comprises a tubular body, and a cap removably mounted on the body.

The body bounds an interior that is at least partly filled with a portion of a moldable product sample. In a preferred embodiment, the product sample is lipstick, although the instant invention is not intended to be limited solely to lipstick samples. Other cosmetic products such as sealers, blush sticks, eyeshadows, makeups, deodorant sticks, etc. are just a few examples of other cosmetic products that can benefit from the instant invention. Of course, this invention is not intended to be limited to cosmetics either, since many other non-cosmetic products can be sampled, such as foods and confections.

The cap bounds an internal mold cavity in communication with the interior of the body. This mold cavity is filled with, and indeed shapes, another portion of the product sample. This shaped portion is exposed for sampling purposes upon removal of the cap from the body.

In a preferred embodiment, the cap is a tilt-off cap having a laterally-offset handle extending past one side of the body. Manual forces such as finger pressure are exerted against the handle for cap removal.

Another feature of this invention resides in resisting marring of the exposed shaped portion during cap removal. A breakable hinge is situated at a side of the body opposite to the side at which the handle is located. The hinge serves to guidingly pivot the cap away from the body during an initial movement away from the body. The cap is frangibly attached to the body with the aid of breakable portions between the cap and the body. These breakable portions fracture during said initial movement. The breakable hinge fractures during a subsequent movement of the cap relative to the body. Preferably, the breakable hinge is a frangible web, and the breakable portions are likewise frangible webs, each web extending between the cap and the body. Thus, cap removal is completed while resisting marring of the exposed shaped portion.

According to the preferred embodiment, the body extends along a longitudinal axis, and the handle extends generally radially of this axis only past said one side of the body. The handle has tapered lower and upper surfaces which converge toward each other in a radially outward direction. The body and the cap each have a generally rectangular cross-section, as considered in a plane transverse to the longitudinal axis.

Another feature of this invention is embodied in affirmatively holding the product sample within the sampler. To that end, an annular collar is provided within the body, and supportably engages an end of the product sample. At least one projection, and preferably a plurality of equiangularly-arranged projections, extend into the interior of the body and penetrate the product sample, thereby supportably engaging the same.

The aforementioned mold cavity is bounded by a smooth wall free of irregularities. The cavity may be shaped as a hemisphere, in which case, the exposed shaped portion will be dome-shaped. Alternatively, the cavity has a concave section and an inclined planar section which together impart a generally wedge form for the exposed shaped portion. The body has an inlet through which the moldable product sample is introduced into the interior of the body and the mold cavity. This inlet may be left open, or closed by a seal or plug.

The product sampler may be provided as discrete units, but in the preferred embodiment, a plurality of such product samplers are frangibly interconnected, preferably by frangible connectors extending between respective bodies. It is contemplated that about a dozen such product samplers are interconnected along a row together to constitute a product sampling arrangement. All of the lipsticks in the arrangement may have the same color or different colors. Indicia or colors on the samplers themselves will depict or describe the colors within each sampler. A purchaser wishing to sample a particular product need only detach one of the product samplers from the arrangement. Detachment can be done by merely snapping the frangible connectors, or by severing these connectors with the aid of a cutting instrument.

Once detached, the product sampler is used by removing the cap from the body, preferably by exerting finger pressure against the handle and tilting the cap. During an initial movement of the cap, the aforementioned breakable portions fracture. During a subsequent movement of the cap, the breakable hinge fractures. Once the shaped portion of the product sample is completely exposed, it may be applied directly to one's lips for evaluation.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a top plan view of a pair of interconnected product samplers according to this invention;

FIG. 2 is a view, partly in section and partly in elevation, taken on line 2—2 of FIG. 1;

FIG. 3 is an enlarged detail of the frangible interconnection between the cap and the body of each sampler depicted in FIG. 2;

FIG. 4 is a front view on a reduced scale of a product sampler being opened;

FIG. 5 is a view analogous to FIG. 1 of another embodiment according to this invention; and FIG. 6 is a view analogous to FIG. 2, taken on line 6—6 of FIG. 5.

DETAILED DESCRIPTION OF THE PREFERRED EMBODIMENTS

Referring now to the drawings, reference numeral 10 generally denotes a product sampling arrangement comprising a plurality of product samplers 12 frangibly interconnected by frangible connectors 14. Although only two samplers 12 have been illustrated, this is not intended to be restrictive of the scope of this invention since, in a preferred embodiment, many more than two samplers are frangibly interconnected along a row. For example, a dozen samplers 12 may be interconnected to constitute the arrangement 10.

Each product sampler 12 comprises a holder or tubular body 16, preferably extending along a longitudinal axis A—A. As shown in FIG. 1, the body has a generally rectangular cross-section, as considered in a plane perpendicular to the longitudinal axis. The body has an interior 18, preferably of circular cross-section, that is at least partly filled with a portion of a moldable product sample 20. The body 16 has a lower end or inlet 22 through which the sample 20 is introduced into the interior, and an outlet 24 at the opposite end of the body.

A cap 26 is removably mounted on the body 16. The cap 26 bounds an internal mold cavity 28 in communication with the outlet 24. The cavity 28 is filled with and shapes a shaped upper portion 30 of the product sample 20. The shaped portion 30 is exposed for sampling purposes upon removal of the cap 26 as described below.

The cap 26 has a laterally-offset handle 32 extending past one side of the body 16. Manual forces such as finger pressure are exerted against the handle 32 for cap removal. The handle 32 extends generally radially of the longitudinal axis A—A only past said one side of the body. The handle 32 has a tapered lower engagement surface 34 against which the tip of one's finger is placed, as well as a tapered upper surface 36. The tapered surfaces 34, 36 converge toward each other in a radially-outward direction. The cap also has a generally-rectangular configuration, as considered in a plane perpendicular to the longitudinal axis.

One feature of this invention resides in resisting marring of the exposed shaped portion 30 during cap removal. A breakable hinge 38 is situated at a side of the body opposite to said one side at which the handle 30 is located. The hinge 38 is a living hinge, advantageously constituted of a single frangible web that extends longitudinally between the cap and the body at said opposite side of the body. The hinge 38 is bendable about a pivot axis B—B that extends transversely of the longitudinal axis. The hinge 38 guidingly pivots the cap away from the body about the pivot axis during an initial movement away from the body, as depicted in FIG. 4.

The cap 26 is frangibly attached to the body 16 by a pair of breakable portions 40, 42, also advantageously constituted as frangible webs extending longitudinally between the cap and the body. The breakable portions are situated at intermediate locations between the opposite sides of the body, preferably centrally located midway between the opposite sides of the body. These breakable portions 40, 42 fracture during said initial movement. As depicted in FIG. 4, breakable portion 40 is shown as being fractured into two parts, namely, 40A, 40B.

During a subsequent movement of the cap relative to the body in the direction of the arrow C in FIG. 4, the breakable hinge 38 fractures to complete the tilting off and removal of the cap, all while resisting marring of the exposed shaped portion 30 of the sample.

The product sample itself may be any moldable material. Although this invention has been specified for the use of cosmetic samplers such as lipsticks, it is not intended to be so limited.

The moldable material is introduced through the inlet 22 into the interior 18 of the body 16, from where the moldable material enters the cavity 28 where the material takes the shape of the cavity. The cavity 28 may have any shape. In a preferred embodiment, the cavity 28 has a concave section 44 and an inclined planar section 46, thereby imparting a generally wedge-shaped configuration to the exposed portion 30. Of course, the cavity 28 may be formed as a hemispherical section, thereby imparting a generally dome-shaped configuration for the exposed portion 30.

After introduction of the moldable material into the interior 18 and cavity 28, the inlet 22 may either be left permanently open, or be closed by a plug or an adhesive tear-off strip 48.

The product sample is normally held within the interior and the cavity. To further insure its retention, an annular collar 50 extends into the interior 18 of the body and supportably engages an end 52 of the product sample. To still further insure that the sample is anchored within the sampler, at least one projection, and preferably a plurality of equiangularly-arranged projections 54 extend radially into the interior of the body and penetrate the lower end of the product sample, thereby supportably engaging the same.

In use of the arrangement 10, a purchaser need only fracture one of the connectors 14 to remove one of the samplers. Alternatively, a cutting implement can be used to sever the connectors 14. Thereupon, by exerting upward fingertip pressure against the lower surface 34 of the handle 32, the cap 26 is tilted back about pivot axis B—B. During this initial movement, as illustrated in FIG. 4, the breakable portions 40, 42 fracture. The hinge 38 has not yet fractured and, instead, maintains the cap out of physical contact with the exposed shaped portion 30. Thereupon, upon subsequent movement of the cap relative to the body, the hinge itself fractures, thereby completing cap removal. The user holds the body while applying the exposed shaped portion to the user's lips for evaluation purposes. After use, the sample may be discarded.

In another implementation of this invention, the product samplers need not be interconnected, but, instead, may be supplied as discrete units, thereby avoiding the necessity of detaching one of the units from other units.

FIGS. 5 and 6 are analogous to FIGS. 1 and 2 and depict a preferred commercial embodiment. Like parts have been identified by like reference numerals increased by a factor of one hundred. Thus, the arrangement 100 includes a plurality of product samplers 112 frangibly interconnected by frangible connectors or webs 114, each sampler having a body 116 in which a sample 120 is contained. A cap 126 is removably mounted on each body, and includes a handle 132. Upon removal of each cap, a hinge 138 breaks during the initial movement, and a pair of breakable portions 140, 142 break during subsequent movement, all as described above.

The arrangement 100 differs from the arrangement 10 in the following respects: The samplers are interconnected at planar webs 114 co-planar with the lower ends of the bodies 116. The curvature of each handle 132 is concave at its lower surface. All of the handles face in the same direction. By contrast, adjacent handles 32 face in opposite directions. Each lower end of the bodies 116 has a hexagonal outline.

It will be understood that each of the elements described above, or two or more together, also may find a useful application in other types of constructions differing from the types described above.

While the invention has been illustrated and described as embodied in an in situ molded product sampler with tilt-off cap, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A product sampler, comprising:

(a) a tubular body bounding an interior at least partly filled with a portion of a moldable product sample; and (b) a tilt-off cap removably mounted on the body and bounding an internal mold cavity in communication with the interior of the body, said mold cavity being filled with, and shaping, a shaped portion of the product sample which is exposed for sampling upon removal of the cap from the body, said cap having a laterally-offset handle extending past one side of the body and against which manual forces are exerted for cap removal.

2. The product sampler according to claim 1; and further comprising means for resisting marring of the exposed shaped portion during cap removal, including breakable hinge means at a side of the body opposite to said one side at which the handle is located, for guidingly pivoting the cap away from the body during an initial movement away from the body; means for frangibly attaching the cap to the body, including breakable portions between the cap and the body that fracture during said initial movement; and wherein the breakable hinge means fractures during a subsequent movement of the cap relative to the body to complete cap removal while resisting marring of the exposed shaped portion.

3. The product sampler according to claim 1, wherein the body extends along a longitudinal axis, and wherein the handle extends generally radially of the longitudinal axis only past said one side of the body.

4. The product sampler according to claim 3, wherein the handle has a tapered lower engagement surface.

5. The product sampler according to claim 4, wherein the handle has a tapered upper surface, said upper and lower surfaces converging toward each other in a radially-outward direction.

6. The product sampler according to claim 3, wherein the body and the cap each have a generally rectangular cross-section, as considered in a plane perpendicular to the longitudinal axis.

7. The product sampler according to claim 2, wherein the body extends along a longitudinal axis; and wherein the breakable hinge means is a frangible web extending longitudinally between the cap and the body at said opposite side of the body, and being bendable about a pivot axis extending transversely of the longitudinal axis during said initial movement.

8. The product sampler according to claim 2, wherein the body extends along a longitudinal axis; and wherein the breakable portions are frangible webs extending longitudinally between the cap and the body at intermediate locations between the opposite sides of the body.

9. The product sampler according to claim 8, wherein the intermediate locations are centrally located midway between the opposite sides of the body.

10. The product sampler according to claim 1; and further comprising means for holding the product sample within the sampler.

11. The product sampler according to claim 10, wherein the holding means includes an annular collar extending into the interior of the body and supportably engaging the product sample.

12. The product sampler according to claim 10, wherein the holding means includes at least one projection extending into the interior of the body and supportably engaging the product sample.

13. The product sampler according to claim 1, wherein the body has an inlet through which the product sample is introduced into the interior of the body and the cavity of the cap.

14. The product sampler according to claim 1, wherein the cavity of the cap is bounded by a smooth wall free of irregularities.

15. The product sampler according to claim 1, wherein the cavity has a concave section and an inclined planar section to impart a generally wedge-shaped configuration to the exposed shaped portion.

16. The product sampler according to claim 1, wherein the product sample is a soft cosmetic.

17. The product sampler according to claim 16, wherein the cosmetic is a lipstick.

18. A product sampling arrangement, comprising:

(a) a plurality of product samplers, each including a tubular body bounding an interior at least partly filled with a portion of a moldable product sample, and a tilt-off cap removably mounted on the body and bounding an internal mold cavity in communication with the interior of the body, said mold cavity being filled with, and shaping, a shaped portion of the product sample which is exposed for sampling upon removal of the cap from the body, said cap having a laterally-offset handle extending past one side of the body and against which manual forces are exerted for cap removal.

19. The product sampling arrangement according to claim 18, wherein the interconnecting means includes frangible connectors, each extending between adjacent bodies of the samplers.

20. The product sampling arrangement according to claim 18, wherein each sampler includes means for resisting marring of the exposed shaped portion during cap removal, including breakable hinge means at a side of the body opposite to said one side at which the handle is located, for guidingly pivoting the cap away from the body during an initial movement away from the body; means for frangibly attaching the cap to the body, including breakable portions between the cap and the body that break during said initial movement; and wherein the breakable hinge means breaks during a subsequent movement of the cap relative to the body to complete cap removal while resisting marring of the exposed product sample portion.

21. A method of using a product sampler, comprising the steps of:

(a) frangibly attaching a cap having an internal mold cavity on a tubular body having an interior, said mold cavity being filled with, and shaping, a shaped portion of a moldable product sample, said interior of the body being at least partly filled with another portion of the product sample; and (b) removing the cap from the body by tilting the cap off the body to expose the shaped portion for sampling.

* * * * *